US009650950B2

(12) United States Patent
Oppenländer et al.

(10) Patent No.: US 9,650,950 B2
(45) Date of Patent: May 16, 2017

(54) CARBURETOR FOR A HAND-GUIDED POWER TOOL AND HAND-GUIDED POWER TOOL

(71) Applicant: Andreas Stihl AG & Co. KG, Waiblingen (DE)

(72) Inventors: Kai Oppenländer, Stuttgart (DE); Antonio Fattorusso, Kernen (DE); Jörg Amann, Walheim (DE); Arne Götzel, Klingenthal (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 466 days.

(21) Appl. No.: 14/108,383

(22) Filed: Dec. 17, 2013

(65) Prior Publication Data

US 2014/0216402 A1 Aug. 7, 2014

(30) Foreign Application Priority Data

Dec. 22, 2012 (DE) ..... 10 2012 025 321

(51) Int. Cl.

| | |
|---|---|
| ***F02M 25/07*** | (2006.01) |
| ***F02B 63/02*** | (2006.01) |
| ***F02M 3/10*** | (2006.01) |
| ***F02M 9/08*** | (2006.01) |
| ***F02D 9/16*** | (2006.01) |
| ***F02M 17/16*** | (2006.01) |

(Continued)

(52) U.S. Cl.

CPC ..... *F02B 63/02* (2013.01); *F02D 9/16* (2013.01); *F02M 3/10* (2013.01); *F02M 9/085* (2013.01); *F02M 17/16* (2013.01); *F02B 2075/025* (2013.01); *F02M 1/16* (2013.01); *F02M 17/04* (2013.01); *F02M 23/03* (2013.01); *F02M 35/108* (2013.01); *F02M 35/1019* (2013.01)

(58) Field of Classification Search

USPC ..... 123/437; 261/83

See application file for complete search history.

(56) References Cited

U.S. PATENT DOCUMENTS

| | | | | |
|---|---|---|---|---|
| 5,709,822 A * | 1/1998 | Togashi | ..... | F02M 3/08 261/44.2 |
| 6,691,988 B1 * | 2/2004 | Warfel | ..... | F02M 3/10 137/382.5 |

(Continued)

FOREIGN PATENT DOCUMENTS

| | | |
|---|---|---|
| DE | 20 2005 000 830 U1 | 7/2006 |
| EP | 1 892 406 A2 | 2/2008 |
| JP | 2004-068772 A | 3/2004 |

*Primary Examiner* — Hung Q Nguyen
*Assistant Examiner* — Ruben Picon-Feliciano
(74) *Attorney, Agent, or Firm* — Gudrun E. Huckett

(57) ABSTRACT

A carburetor for a hand-guided power tool has a carburetor housing and a carburetor rotor supported rotatably in the carburetor housing about an axis of rotation. A needle is disposed on the carburetor rotor and projects into a fuel opening of the carburetor. An adjusting element is operatively connected to the needle so as adjust a position of the needle relative to the carburetor rotor. The adjusting element has an engagement contour that is to be engaged by a tool for adjusting the adjusting element. A securing contour that is fixedly connected to the carburetor rotor is provided. The securing contour, at any point of the securing contour, has a spacing to the axis of rotation of at least approximately 10 mm.

18 Claims, 3 Drawing Sheets

(51) Int. Cl.

| | |
|---|---|
| *F02M 35/10* | (2006.01) |
| *F02M 35/108* | (2006.01) |
| *F02M 1/16* | (2006.01) |
| *F02M 17/04* | (2006.01) |
| *F02M 23/03* | (2006.01) |
| *F02B 75/02* | (2006.01) |

(56) References Cited

U.S. PATENT DOCUMENTS

| | | | | |
|---|---|---|---|---|
| 7,077,387 | B1 * | 7/2006 | White | F02M 3/08<br>137/382 |
| 8,166,931 | B2 | 5/2012 | Zwimpfer | |

* cited by examiner

CARBURETOR FOR A HAND-GUIDED POWER TOOL AND HAND-GUIDED POWER TOOL

BACKGROUND OF THE INVENTION

The invention relates to a carburetor for a hand-guided power tool and further to a hand-guided power tool.

JP 2004-068772A discloses a carburetor for a hand-guided power tool in which the position of the carburetor needle in a fuel opening is adjustable by means of an adjusting screw. The adjusting screw is arranged in a depression and is surrounded by a circumferential wall.

It is known to design the distance between the circumferential wall and the adjusting element to be so small that the adjusting element can be adjusted only by means of a special tool provided for adjustment. The adjustment is to be performed in particular during manufacture of the power tool and when the power tool is being serviced. In this way, a faulty adjustment caused by the operator is prevented.

The position of the needle relative to the carburetor rotor is adjusted during manufacture of the power tool in accordance with geometric considerations. The actual position of the needle relative to the carburetor rotor depends on manufacturing tolerances so that the fuel quantity supplied to the internal combustion engine in operation may differ, depending on the different tolerances between carburetors. In order to ensure for all possible tolerance combinations an excellent running behavior of the internal combustion engine, the carburetor must be adjusted to supply a comparatively rich mixture.

SUMMARY OF THE INVENTION

The object of the invention is to provide a hand-guided power tool that has excellent running behavior and minimal emissions. A further object of the invention resides in that a carburetor for a hand-guided power tool is to be provided that enables excellent running behavior of an internal combustion engine with minimal fuel consumption.

With regard to a carburetor that is provided with a carburetor housing in which a carburetor rotor is supported rotatably about an axis of rotation, wherein on the carburetor rotor a needle is disposed which projects into a fuel opening of the carburetor, wherein the position of the needle relative to the carburetor rotor is adjustable by means of an adjusting element, wherein the adjusting element has an engagement contour on which a tool for adjusting the adjusting element can engage and wherein the engagement contour is arranged in a recess that is delimited by a circumferential wall, this object is solved in that the carburetor has a securing contour that is fixedly connected with the carburetor rotor and in that the spacing of the securing contour to the axis of rotation at any point of the securing contour is less than approximately 10 mm.

With regard to the hand-guided power tool that is provided with a power tool housing in which a carburetor for supply of fuel and combustion air to the internal combustion engine is arranged, wherein the carburetor has a carburetor housing in which a carburetor rotor is supported rotatably about an axis of rotation, wherein on the carburetor rotor a needle is disposed which projects into a fuel opening of the carburetor, wherein the position of the needle relative to the carburetor rotor is adjustable by an adjusting element, wherein the adjusting element has an engagement contour on which a tool for adjusting the adjusting element can engage, the object is solved in that the carburetor has a securing contour that is fixedly connected to the carburetor rotor and in that the spacing of the securing contour to the axis of rotation at any point of the securing contour is less than approximately 10 mm.

The securing contour enables fixation of the rotatably supported carburetor rotor and movement of the adjusting element relative to the securing contour. By fixation of the carburetor rotor, an adjustment of the position of the needle relative to the carburetor rotor is possible without the carburetor rotor being turned also. The fixation of the securing contour can be realized by means of an auxiliary tool of a simple configuration. Since the carburetor rotor by means of the securing contour can be fixed positionally for adjusting the adjusting element in a simple way, an adjustment of the needle in operation, i.e., as the internal combustion engine is running, is possible also. In this way, a particularly precise adjustment can be achieved. The adjustment can be done manually or automatically. By means of the securing contour, the carburetor rotor can be advantageously secured in the idle position of the carburetor rotor for adjustment of the needle. By means of the securing contour, it is however also possible to adjust predetermined rotational positions of the carburetor rotor and to adjust for these rotational positions the position of the needle relative to the carburetor rotor. In this way, a particularly precise adjustment is possible. Due to the precise adjustment, emissions can be minimized for the internal combustion engine. Manufacturing tolerances, which for a purely geometric adjustment of the position of the needle in the fuel opening cannot be taken into account, can be compensated with the invention upon adjustment of the position of the needle in operation of the internal combustion engine which is enabled by the securing contour.

The adjustment of the carburetor is realized advantageously when the carburetor is mounted in the hand-guided power tool. The securing contour must therefore be accessible from the exterior through the power tool housing of the power tool. For hand-guided power tools which in operation are exposed to soiling, it is desirable to have a power tool housing that provides a substantially completely closed envelope. In order to enable, despite of this requirement, an adjustment of the carburetor in operation, it is provided that the securing contour is arranged close to the axis of rotation of the carburetor rotor. The spacing of the securing contour to the axis of rotation is, at any point of the securing contour, less than approximately 10 mm. A power tool housing opening through which the securing contour is accessible can therefore be comparatively small. The spacing is measured in this context in a plane that is perpendicular to the axis of rotation of the carburetor rotor. The needle as a result of the rotational movement of the carburetor rotor in operation must be arranged such that the longitudinal axis of the needle coincides with the axis of rotation of the carburetor rotor. In this way, securing contour and engagement contour (adjusting contour) for adjusting the adjusting device can be arranged such that they are accessible through a common power tool housing opening. Advantageously, the spacing of the securing contour to the axis of rotation at any point of the securing contour is less than approximately 8 mm.

The securing contour is in particular concentric to the axis of rotation of the carburetor rotor. Advantageously, the engagement contour is arranged in a recess that is delimited by a circumferential wall. The circumferential wall delimits the access to the engagement contour and prevents that a tool that is not designed for adjusting the needle can be brought into engagement with the engagement contour.

Advantageously, the securing contour is arranged on the circumferential wall. In this way, for the securing contour no additional space is required. The securing contour is in particular provided at an end face of the circumferential wall. The tool for fixation of the securing contour can engage in a simple way the securing contour that is provided at the end face of the circumferential wall. The tool for fixation of the securing contour can be designed as a sleeve surrounding the tool for adjustment of the adjusting contour. In this way, a compact and simple configuration is provided.

A simple configuration results when the securing contour is formed immediately on the circumferential wall. The securing contour is advantageously formed by recesses or depressions in the circumferential wall that extend from the end face into the circumferential wall. The configuration of the securing contour therefore requires no additional components. The circumferential wall is comprised advantageously of plastic material so that the securing contour together with the circumferential wall can be produced by molding plastic material by an injection molding process. For producing the securing contour no additional manufacturing steps are thus required.

The outer circumference of the circumferential wall is advantageously comparatively small so that a compact configuration results. The outer diameter of the circumferential wall at the securing contour is advantageously less than approximately 15 mm. In particular, the outer diameter of the circumferential wall at the securing contour is less than approximately 12 mm. The outer diameter of the circumferential wall is advantageously at most 2.5 times as large as the diameter of the engagement contour. The outer diameter of the circumferential wall is measured at the securing contour and defines the greatest outer diameter of the circumferential wall at the securing contour.

Advantageously, the circumferential wall has a circular cross-section. The circumferential wall is in this context advantageously arranged concentrically to the axis of rotation of the carburetor rotor. The circumferential wall surrounds the engagement contour advantageously so tightly that only a tool that is especially designed for this purpose can engage the engagement contour. The spacing between the circumferential wall and the engagement contour corresponds advantageously at most to half the diameter of the engagement contour. The diameter of the engagement contour is defined as the greatest diameter in case of an irregularly designed engagement contour. It can also be provided that the engagement contour is formed at the end face of the adjusting element. In this case, the circumferential wall can surround tightly and at a very small spacing the adjusting element. The spacing between the circumferential wall and the engagement contour is advantageously at most approximately 2.5 mm. For adjusting the adjusting element via the engagement contour, a special tool is advantageously provided. In order to prevent engagement of another tool at the engagement contour, the spacing between the circumferential wall and the engagement contour is set in particular to be at most approximately 1.5 mm. Preferably, the spacing between the circumferential wall and the engagement contour is approximately 0.8 mm up to approximately 1.2 mm.

The securing contour has advantageously at least one tooth. In particular, several teeth are distributed uniformly at the end face of the circumferential wall. Particularly advantageous are four teeth. A different number of teeth can be advantageous also. The securing contour has advantageously at least one first flank which in a side view is positioned relative to the axis of rotation of the carburetor rotor at an angle of less than approximately 10°, in particular less than 5°. The first flank is in particular approximately parallel to the axis of rotation of the carburetor rotor. Since the first flank of the securing contour is positioned at a small angle or approximately parallel to the axis of rotation of the carburetor rotor, the securing forces can be transmitted particularly well. The first flank is advantageously oppositely oriented relative to the rotational direction of the carburetor rotor when rotating from an idle position to a full throttle position. Upon rotation of the carburetor rotor in the direction of rotation from the idle position to the full throttle position, the first flank is the leading flank. In this way, the carburetor rotor can be secured well in the idle position so that in particular an adjustment of the position of the needle at idle is possible in a simple way. Advantageously, the securing contour has at least one second flank which relative to the axis of rotation of the carburetor rotor is positioned at a slant. The second flank is positioned relative to the axis of rotation of the carburetor rotor advantageously at an angle that is approximately from 20° to approximately 70°. The angle between the second flank and the axis of rotation is in particular approximately 30° up to approximately 60°. As a result of its slanted position relative to the axis of rotation of the carburetor rotor, the second flank enables a simple engagement of a securing tool on the securing contour and an automatic centering between the flanks. In this way, an automated adjustment of the adjusting element is also simplified. The first and second flanks are advantageously formed on the at least one tooth.

The engagement contour is expediently a special contour to be engaged by a special tool. In this way, it is ensured that an adjustment of the carburetor can be done only during manufacture of the power tool or during servicing. An improper adjustment of the carburetor is therefore avoided.

For a hand-guided power tool with a power tool housing in which a carburetor is arranged for supply of fuel and combustion air to the internal combustion engine, wherein the carburetor has a carburetor housing in which a carburetor rotor is rotatably supported about an axis of rotation, wherein on the carburetor rotor a needle is disposed which projects into a fuel opening of the carburetor, wherein the position of the needle relative to the carburetor rotor is adjustable by an adjusting element, wherein the adjusting element has an engagement contour that can be engaged by a tool for adjusting the adjusting element, it is provided according to the invention that the carburetor has a securing contour which is connected fixedly with the carburetor rotor and it is further provided that the spacing of the securing contour to the axis of rotation at any point of the securing contour is less than approximately 10 mm, in particular less than 8 mm.

Advantageously, the power tool housing of the power tool has a housing opening through which the securing contour is accessible. In this way, an adjustment of the adjusting element while the internal combustion engine is running, i.e., in operation, is possible without problems. In order to prevent soiling of the housing interior and damage to the power tool housing upon impact, the housing opening should be as small as possible. Between the securing contour and the housing opening advantageously a slot is formed. The greatest width of the slot measured in a plane perpendicular to the axis of rotation is advantageously less than approximately 7 mm, in particular less than approximately 4 mm. The greatest width of the slot is advantageously smaller than the diameter of the engagement contour. Advantageously, the securing contour is formed on the end face of the circumferential wall so that only a very small space for the securing contour and thus only a very small housing opening for engagement of a tool on the securing contour is required. The slot is advantageously designed such that a round rod with a diameter of 7 mm cannot be inserted into the slot. In this way, it is avoided that in operation branches or twigs or the like can pass through the slot into the power tool housing and cause damage.

The power tool has advantageously a starter device for starting the combustion engine. The starter device advantageously serves to position the carburetor rotor in a starting position. A simple configuration results when on the exterior side of the circumferential wall which is facing away from the recess a locking contour is arranged which is a component of the starter device. On the circumferential wall one or several reinforcement webs can be provided also. Since these elements are positioned outside of the circumferential wall, they are not suitable for fixation of the carburetor rotor for the purpose of adjustment of the adjusting element because they are not accessible through the housing opening from the exterior and therefore do not permit adjustment in operation.

One embodiment of the invention will be explained in more detail in the following with the aid of the drawings.

DESCRIPTION OF THE PREFERRED EMBODIMENTS

Figure 1:
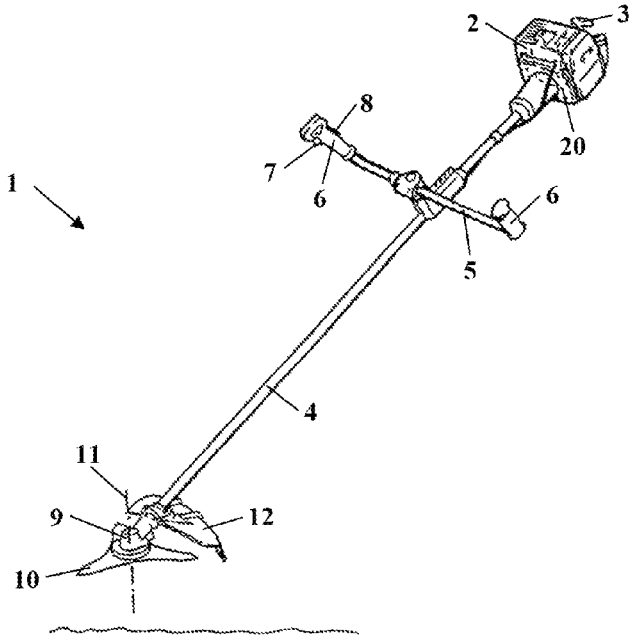
FIG. 1 is a schematic perspective illustration of a power tool.

FIG. 1 shows a hand-guided power tool 1 in the form of a trimmer. The power tool 1 can however also be in the form of another hand-guided power tool, for example, a motor chainsaw, cut-of machine, hedge trimmer, blower, harvester such as an olive shaker, or the like. In case the power tool is a blower or a suction device, the tool member that is driven by the power tool by means of the internal combustion engine is the fan wheel that creates the working air stream.

The power tool 1 has a power tool housing 2 from which a starter grip 3 is projecting for starting the internal combustion engine 20 arranged in the housing 2 and illustrated schematically in FIG. 1. The housing 2 is connected by a guide tube 4 with a gear head 9. A drive shaft, not illustrated, extends through the guide tube 4 and drives via a gearbox arranged in the gear head 9 the tool member 10 in rotation about axis of rotation 11. The tool member 10 is in this embodiment a knife. The tool member 10 can also be a mowing head operating with a trimmer line, or the like. Adjacent to the gear head 9, a guard 12 is attached on the guide tube 4.

For guiding the power tool 1, a handlebar 5 having two handles 6 is attached to the guide tube 4. On one of the handles 6 the throttle trigger 7 as well as the throttle trigger lock 8 are supported. The throttle trigger 7 serves for operating the internal combustion engine.

Figure 2:
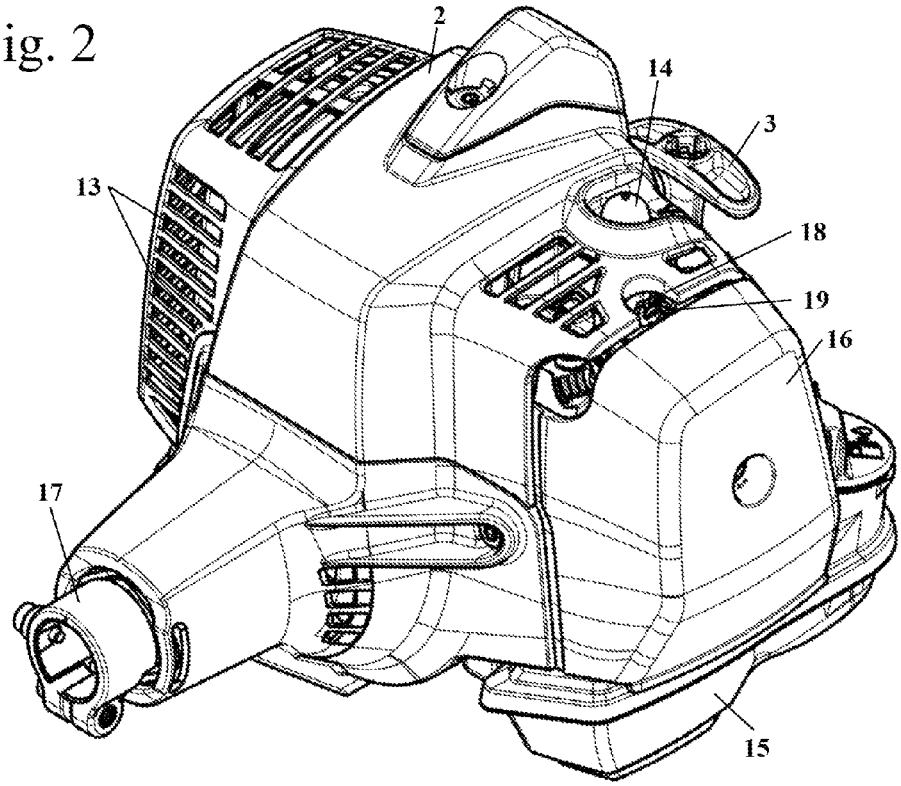
FIG. 2 shows the power tool housing of the power tool in perspective illustration.
Figure 3:
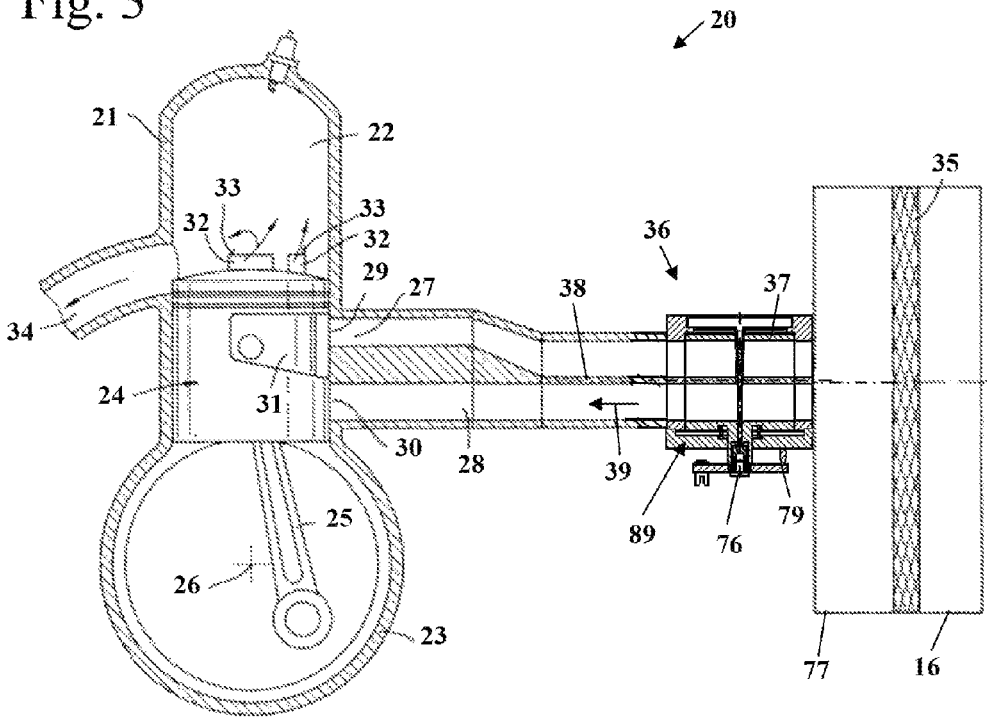
FIG. 3 is a schematic section illustration of the internal combustion engine of the power tool.

As shown in FIG. 2, the power tool housing 2 has a plurality of cooling openings 13. The cooling openings 13 allow entry and exit of cooling air. The housing 2 has an air filter cover 16 and an air filter 35, schematically indicated in FIG. 3, is arranged underneath. The air filter cover 16 forms part of the power tool housing 2. Purger bellows 14 is projecting from the power tool housing 2 and serves for conveying fuel into the fuel system of a carburetor of the power tool 1. For attachment of the power tool housing 2 on the guide tube 4 a fastening clamp 17 is provided. The power tool 1 has also a fuel tank 15.

As shown in FIG. 2, adjacent to the air filter cover 16 a housing opening 18 is provided in the housing 2. Through the housing opening 18 a securing contour 19 located immediately below the housing opening 18 is accessible.

FIG. 3 shows schematically the internal combustion engine 20 of the power tool 1. The combustion engine 20 is advantageously a two-stroke engine, in particular a single cylinder engine.

The internal combustion engine 20 has a cylinder 21 in which a combustion chamber 22 is formed. The combustion chamber 22 is delimited by a piston 24 which is reciprocatingly supported in the cylinder 21. The piston 24 drives by means of connecting rod 25 a crankshaft 26 in rotation which is rotatably supported in the crankcase 23. The combustion chamber 22 has an outlet 34 for exhaust gases. A mixture passage 28 opens with mixture inlet 30 at the cylinder 21 into the crankcase 23; an air passage 27 opens with at least one air inlet 29 at the cylinder 21. The air inlet 29 is connected by means of at least one piston recess 31 formed within the piston 24 with one or several transfer ports 33 of one or several transfer passages 32 when the piston 24 is in the range of top dead center. The transfer passages 32 connect the interior of the crankcase 23 in the range of bottom dead center of the piston 24 with the combustion chamber 22. The air passage 27 and the mixture passage 28 are separated from each other by a partition 38 across at least a portion of their length. The air passage 27 and the mixture passage 28 are partially formed in a carburetor 36 and are connected to the clean side of the air filter 35. The air filter 35 is secured between the air filter cover 16 and the air filter bottom 77. In the embodiment, the air filter 35 is a flat filter. However, various other configurations of the air filter 35 are possible. The air filter 35 is advantageously secured in position by the air filter cover 16.

The carburetor 36 is designed as a rotor-operated carburetor and has a carburetor rotor 37 which is rotatably supported about axis of rotation 76. Upon rotation, the carburetor rotor 37 is axially moved in the direction of the axis of rotation 76. For this purpose, a cam contour 79 is provided which is indicated schematically in FIG. 3. In FIG. 3, the carburetor rotor 37 is shown in its full throttle position 89 in which the carburetor rotor 37 substantially opens the flow cross-section of the air passage 27 and mixture passage 28, in particular opens them completely.

In operation fuel/air mixture flows in flow direction 39 from the mixture passage 28 through the mixture inlet 30 into the crankcase 23 when the piston 24 is at top dead center. Upon downward stroke of the piston 24, the fuel/air mixture in the crankcase 23 is compressed and flows at bottom dead center of the piston 24 into the combustion chamber 22 where it is ignited when compressed again due to the subsequent upward stroke of the piston 24. Combustion accelerates the piston 24 in downward direction toward bottom dead center. As soon as the piston 24 opens the outlet 34, the exhaust gases flow out of the combustion chamber 22.

When the piston 24 is at top dead center, by means of the air passage 27 air that is free of fuel or contains only little fuel is stored in the transfer passages 32. This air flows then at bottom dead center of the piston 24 into the combustion chamber 23 and scavenges the exhaust gases through outlet 34 before fresh fuel/air mixture is flowing from the interior of the crankcase 23 through the transfer passages 32 into the combustion chamber 22.

Figure 4:
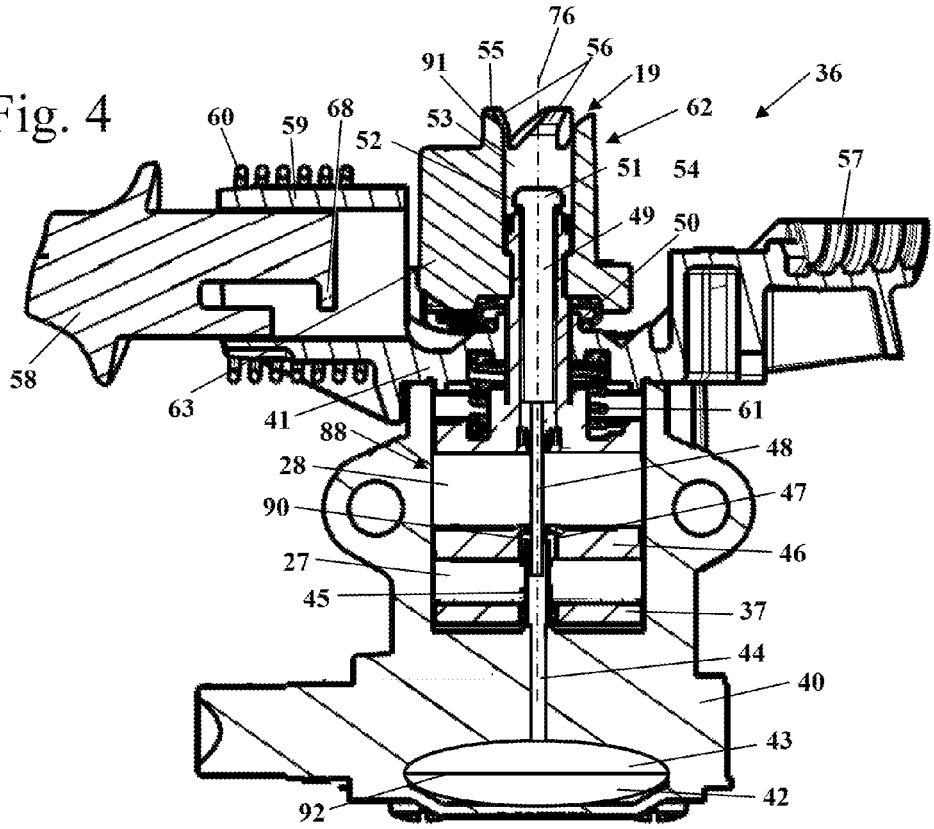
FIG. 4 is a schematic section illustration of the carburetor of the power tool.

FIG. 4 shows the configuration of the carburetor 36 in detail. The carburetor 36 has a carburetor housing 40 in which the carburetor rotor 37 is supported so as to rotate about axis of rotation 76. The side of the carburetor housing 20 where the carburetor rotor 37 is inserted into the carburetor housing 40 is closed off by cover 41. Concentric to the axis of rotation 76, a fuel passage 44 projects into the carburetor rotor 37. The fuel passage 44 in the illustrated embodiment is designed as a fuel tube 45. At the end of the fuel passage 44, a fuel opening 90 is formed and opens into the mixture passage 28. The fuel passage 44 is supplied with fuel from the control chamber 43, which is shown schematically in FIG. 4 and is configured as is conventional in the art. The control chamber 43 is separated by a control diaphragm 92 from a compensation chamber 42. The carburetor 36 is therefore embodied as a diaphragm carburetor. In the illustrated embodiment, the control chamber 43 is arranged at the side of the carburetor 36 which is facing away from the mixture passage 28. The fuel tube 45 projects through the air passage 27. The fuel opening 90 is arranged in the area of the partition section 46. The partition section 46 is formed on the carburetor rotor 37 and is a component of the partition 38 (FIG. 3) that separates the air passage 27 and the mixture passage 28.

From the side of the carburetor 36 which is opposite the fuel passage 44 and the control chamber 43, a needle 48 projects into the fuel opening 90. The depth at which the needle 48 projects into the fuel tube 45 is used to control the fuel quantity that is supplied through the fuel opening 90. As shown in FIG. 4, the fuel tube 45 and the needle 48 project from opposite sides into an opening 47 of the partition section 46. It can also be provided that the fuel tube 45 penetrates through the partition section 46 at the opening 47.

The carburetor rotor 37 is slidable by a predetermined stroke in the direction of the axis of rotation 76. Upon axial displacement of the carburetor rotor 37 as a result of rotational movement from the idle position 88 to the full throttle position 89 the needle 48 moves out of the fuel tube 45 and increases thereby the fuel quantity that is supplied to the mixture passage 28. The carburetor rotor 37 is spring-loaded by a spring 67 which pretensions the carburetor rotor 37 in the direction in which the needle 48 is positioned farthest inside the fuel tube 45.

In FIG. 4, the carburetor rotor 37 is illustrated in its idle position 88 in which the needle 48 is inserted farthest inside the fuel tube 45. Only a minimal flow cross-section is open because the sections of mixture passage 28 and air passage 29 formed in the carburetor rotor 37 are arranged transverse to the flow direction 39 (FIG. 3). FIG. 3 shows the carburetor rotor 37 in full throttle position 89 in which the sections of air passage 27 and mixture passage 28 formed in the carburetor rotor 37 are aligned in the flow direction 39 so that the maximum free flow cross-sections result.

For starting the internal combustion engine 20 a starting device is provided that comprises an actuating button 58. The actuating button 58 is supported in a guide 59 so as to be rotatable and movable in a longitudinal direction. Displacement in the longitudinal direction is possible only in a constructively predetermined position. The actuating button 58 is spring-loaded in rotational direction as well as in axial direction by a spring 60 that pretensions or biases the actuating button 58 in the direction of its non-actuated rest position. The actuating button 58 has a hook 68, illustrated in FIGS. 4 and 6, that forms a locking element and interlocks in the starting position with a hook 63 which is fixedly connected to the carburetor rotor 37.

FIG. 4 shows that the hook 63 is formed on an actuating element 62 which is fixedly secured on the carburetor rotor 37. The actuating element 62 and the carburetor rotor 37 are positioned on the opposite sides of the cover 41. The actuating element 62 is fixedly attached to the carburetor rotor 37, i.e., is immobile relative to the carburetor rotor 27 in rotational direction about the axis of rotation 76 as well as in longitudinal direction of the axis of rotation 76.

In order to be able to adjust the position of the needle 48 in the fuel tube 45 and to adjust thereby the fuel quantity which is supplied to the mixture passage 28, the position of the needle 48 in longitudinal direction of the axis of rotation 76 is adjustable relative to the carburetor rotor 37. For this purpose, an adjusting element 49 is provided which in the embodiment is formed as a screw that is fixedly connected with the needle 48 and can be threaded into a thread 50. The thread 50 is formed on the carburetor rotor 37 or an element which is fixedly connected with the carburetor rotor 37. The adjusting element 49 has a head 51 having at its outer circumference an engagement contour 52. The engagement contour 52 is a special contour that is not standardized and is adjustable only by a special tool. In the embodiment, the engagement contour 52 is designed as a rounded hexagon. However, any other engagement contour, for example, rounded external contours or engagement contours that are provided at the end face, for example, a specially designed slot or crossed slots can be provided. By screwing the adjusting element 49 into the thread 50 or unscrewing it from the thread 50, i.e., by turning the adjusting element 49 relative to the carburetor rotor 37, the insertion depth of the needle 48 in the fuel passage 45 is adjusted.

The engagement contour 52 is surrounded by a circumferential wall 54. In this way it is ensured that the adjusting element 49 can be adjusted only by means of a special tool provided for this purpose that can be inserted into the circumferential wall 54. The circumferential wall 54 is concentrically arranged about axis of rotation 76 and has in the illustrated embodiment a circular ring-shaped cross-section. The circumferential wall 54 extends approximately cylindrically in longitudinal direction of the axis of rotation 76 with slightly slanted walls in order to enable mold release upon manufacture of the circumferential wall 54 by an injection molding process. In order to enable adjustment of the position of the needle 48 relative to the carburetor rotor 37 through the power tool housing 20 of the power tool even when the internal combustion engine 20 is running, the securing contour 19 illustrated also in FIG. 2 is provided which is accessible from the exterior of the power tool housing 2. The securing contour 19 is formed on an end face 55 of the circumferential wall 54 and comprises several, in the illustrated embodiment four, teeth 56. The hook 63 is arranged on an external side 91 of the circumferential wall 54 which is positioned externally relative to the axis of rotation 76. The circumferential wall 54 delimits a recess 53 which is cylindrical and which is provided at its bottom with the head 51 of the adjusting element 49.

Figure 6:
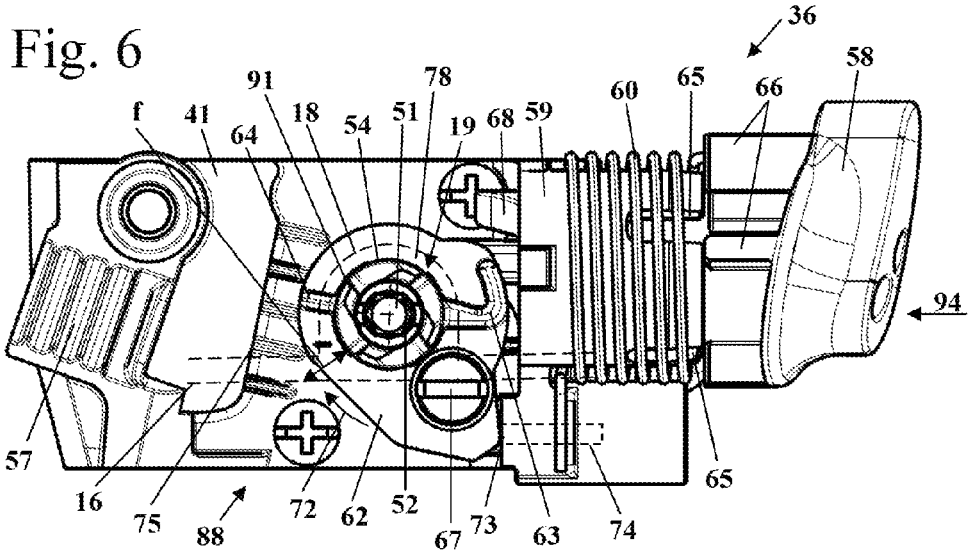
FIG. 6 is a plan view of the carburetor.

As indicated in FIGS. 4 and 6, on the cover 41 a holder 57 for the external sleeve or casing of a Bowden cable is arranged. In the embodiment, the holder 57 is arranged on the side of the carburetor 36 which is opposite the actuating button 58.

Figure 5:
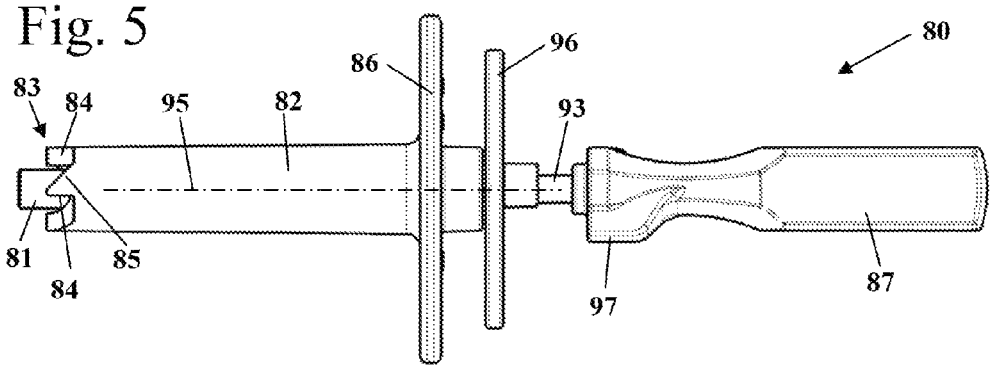
FIG. 5 is a side view of a tool for adjusting the adjusting element of the carburetor.

FIG. 5 shows a special tool 80 for adjusting the position of the needle 48. The special tool 80 has a grip 87 which is connected as is conventional by means of a shaft 93 with an engagement section 81. The engagement section 81 in the illustrated embodiment is approximately cylindrical and has at its inner side a special contour, not illustrated, which corresponds to the engagement contour 52 of the head 51 and is thus able to engage it. The special contour is no standardized contour but is a special contour that is matched to the engagement contour 52. A securing device 82 is pushed onto the shaft 93. The securing device 82 is advantageously loosely pushed onto the shaft 93. The securing device 82 can however also be secured fixedly in axial direction on the shaft 93 but so as to be rotatable on the shaft 93. The securing device 82 has a securing section 86 where an operator or an adjusting machine can secure the securing device 82. On its end face that is facing away from the grip 87 and away from the securing section 86, the securing device 82 has a counter contour 83 that engages the securing contour 19. The counter contour 83 has flanges 84 and 85 which will be explained in the following in more detail. An adjusting section 96 is arranged on the securing device 82 and is advantageously secured by clamping action on the securing device 82. The adjusting section 96 is provided with a scale. The grip 87 has an alignment section 97. When the counter contour 83 and the engagement section 81 are in engagement with the engagement contour 52 and the securing contour 19, the alignment section 97 is aligned with the zero position of the scale at the adjusting section 96. This is realized by means of adjusting the adjusting section 96 relative to the securing device 82 by overcoming the clamping force. When adjusting the position of the needle 48, the securing section 86 as well as the adjusting section 96 are held by the operator. The angle about which the engagement section 81 is rotated with respect to the engagement contour 52 can be read out by means of the alignment section 97 on the scale.

In FIG. 6, the carburetor 36 is illustrated in idle position 88. In this position, the actuating element 62 is resting at an idle stop 73. The idle stop 73 is advantageously embodied by an adjusting element 74, for example, a screw. In this way, the rotational position of the carburetor rotor 37 and thus also the position in longitudinal direction of the axis of rotation 76 in idle position 88 can be adjusted. For effecting acceleration of the engine, on the actuating element 62 a Bowden cable receptacle 67 is provided into which a Bowden wire of a Bowden cable arrangement, not illustrated, is inserted. The sleeve or casing of the Bowden cable arrangement is secured in the holder 57. When pulling the Bowden wire, the actuating element 62 and thus also the carburetor rotor 37 are moved in rotational direction 72. Due to the spring 61 (FIG. 4) the carburetor rotor 37 is pretensioned in the direction of the idle position 88. The Bowden cable arrangement is advantageously actuated by means of throttle trigger 7 (FIG. 1). Adjacent to the holder 57 a full throttle stop 57 is formed on the cover 41 and is contacted by the actuating element 62 in full throttle position 89.

In order to select a starting position, the actuating button 58 is rotated in counterclockwise direction, when viewed from the exterior of the power tool housing 2, and subsequently is pushed in the direction of arrow 94 in FIG. 6 into the guide 59. As also shown in FIG. 6, the actuating button 58 has noses 66 which are extending parallel to arrow 94, i.e., in the direction in which the actuating button 58 is pushed into the guide 59. The guide 59 has slots 65 that can be engaged by the noses 66 in the rotational position that is provided for suppressing the actuating button 58. As shown in FIG. 6, the actuating button 58 in non-actuated position cannot be pushed in the direction of arrow 94 because the noses 66 are contacting the end face of the guide 59 in the illustrated rotational position. First, the actuating button 58 must be rotated in counterclockwise direction by somewhat less then 90° until the noses 66 are aligned with the slots 65. Subsequently, the actuating button 58 can be moved in the direction of arrow 94. The rotational movement of the actuating button 58 as well as the movement in the direction of arrow 94 into the guide 59 is done against the force of the spring 60.

In the suppressed position in the guide 59, the hook 68 of the actuating button 58 locks with the hook 63 on the actuating element 62. In this way, the starting position is adjusted. On the actuating button 58 a contour can be provided which lifts the carburetor rotor 37 in the starting position in order to increase the supplied fuel quantity for the starting operation. The carburetor rotor 37 is advantageously slightly adjusted relative to its idle position 88 in the direction toward full throttle position 89, i.e., adjusted in the rotational direction 72, so that also the sucked-in air quantity is increased relative to idle position 88. For release of the start position, the operator accelerates so that the actuating element 62 is pivoted in rotational direction 72 and the hook 63 is disengaged from the hook 68. Instead of hooks 63 and 68, also other elements can be provided for adjusting the starting position, in particular for locking the elements in the starting position.

FIG. 6 shows in dashed lines the contour of the housing opening 18. As shown in FIG. 6, between the housing opening 18 and the circumferential wall 54 there is only a small slot 78. The slot 78 has a circular ring configuration at the area that is facing away from the air filter cover 16; at the side that is facing the air filter cover 16, the slot 78 is delimited by the straight air filter cover 16 and the circular circumferential wall 54 so that the width of the slot 78 in this area is not constant. The slot 78 has a greatest width f which is measured in the embodiment relative to the air filter cover 16. The width f is less than approximately 7 mm, in particular less than approximately 4 mm. In the illustrated embodiment, the width f is less than approximately 3 mm. The width e, f of the slot 78 is measured perpendicularly to the circumferential wall 54 and to the axis of rotation 76 radially in outward direction. Since the slot 78 is narrow it is not possible to positionally secure the actuating element 62 (fixedly connected to the carburetor rotor 37) by means of the elements which are arranged on the exterior side 91 of the circumferential wall 54, i.e., the hook 63 and a reinforcement rib 64 also arranged on the exterior side 91. For fixation of the carburetor rotor 37, the securing contour 19 on the end face 55 of the circumferential wall 54 is therefore provided.

Figure 7:
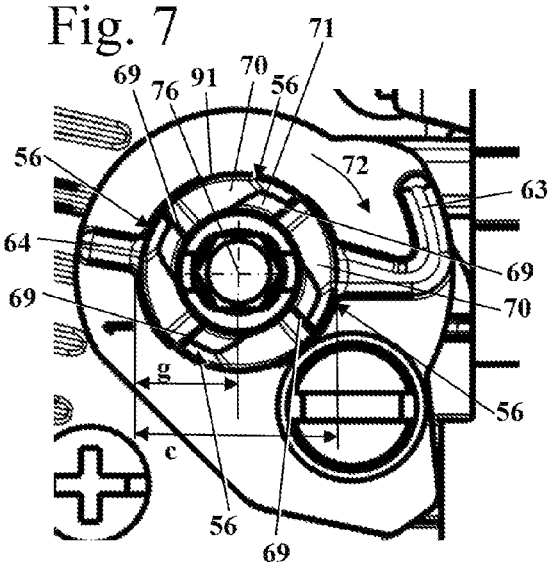
FIG. 7 is an enlarged illustration of the plan view of the carburetor rotor as shown in FIG. 6.
Figure 8:
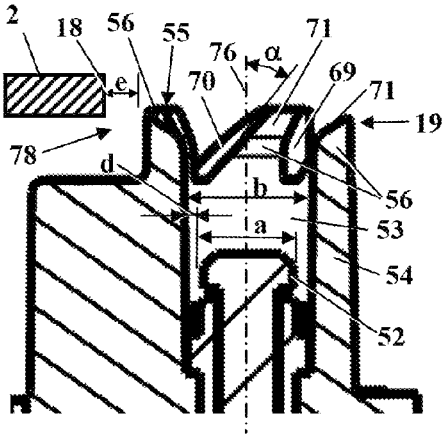
FIG. 8 is an enlarged illustration of the area of the securing contour of the carburetor of FIG. 4.

FIGS. 7 and 8 show the constructive design of the securing contour 19 in detail. As shown in FIGS. 7 and 8, the securing contour 19 has first flanks 69 which in the embodiment are parallel to the axis of rotation 76. The first flanks 69 are advantageously positioned relative to the axis of rotation 76, in a side view, at an angle that is at most approximately 10°, in particular at most approximately 5°. The first flanks 69 are oriented opposite to the rotational direction 72. The first flanks 69 are therefore the leading flanks of the teeth 56 upon rotation of the carburetor rotor 37 in rotational direction 72. The securing contour 19 has also second flanks 70 which in rotational direction 72 are facing away. Upon rotation in rotational direction 72 the second flanks 70 are the trailing flanks of the teeth 56. As shown in particular in FIG. 8, the second flanks 70 are of a slanted configuration. The second flanks 70 are positioned in a section illustration through axis of rotation 76, as illustrated in FIG. 8, at an angle α relative to the axis of rotation 76. The angle α is advantageously approximately 20° to approximately 70°, in particular approximately 30° to approximately 60°. Other angles α can also be advantageous however. Advantageously, the first flanks 69 have a slant relative to the axis of rotation 76 that is smaller than that of the second flanks 70.

As shown in FIGS. 7 and 8, the teeth 56 have at their side which is facing the recess 53 an insertion ramp 71 that facilitates insertion of the tool 80. The circumferential wall 54 has outer diameter c as shown in FIG. 7. The outer diameter c is measured relative to the axis of rotation 76 for a slanted extension of the circumferential wall 54 at the securing contour 19. The outer diameter c is less than approximately 20 mm, advantageously less than approximately 15 mm, in particular less than approximately 12 mm. In the embodiment the outer diameter c is less than 11 mm. The securing contour 19 has relative to the axis of rotation 76 a spacing g which is measured in a plane perpendicular to the axis of rotation 76. The spacing g as a result of the circular form of the outer circumference is constant in the embodiment and is less than approximately 10 mm, in particular less than approximately 8 mm. Advantageously, the spacing g is less than approximately 6 mm. When the spacing of the securing contour 19 to the axis of rotation 76 is not constant, the spacing g is the greatest spacing of the securing contour 19 relative to the axis of rotation 76.

The counter contour 83 of the securing device 82 (FIG. 2) has a third flank 84 which is parallel to a longitudinal direction 95 of the shaft 93. The longitudinal direction 95 upon engagement of the counter contour 83 with the securing contour 19 is aligned congruently with the axis of rotation 76. When the counter contour 83 engages the securing contour 19, the third flanks 84 are resting on the first flanks 69. The counter contour 83 has fourth flanks 85 which are slanted in accordance with the second flanks 70 and upon engagement of the counter contour 83 at the securing contour 19 are resting on the second flanks 70.

FIG. 8 also shows the dimensions of the arrangement in detail. The engagement contour 52 has a diameter a that is only slightly smaller than the inner diameter b of the circumferential wall 54. The inner diameter b is advantageously less than approximately 10 mm, in particular less than approximately 7 mm. The diameter a is the greatest diameter of the engagement contour 52. The diameter a is advantageously less than approximately 8 mm, in particular less than approximately 6 mm. It is particularly advantageous when the diameter a is less than approximately 5 mm. The spacing d which is formed between the circumferential wall 54 and the engagement contour 52 is advantageously at most half the size of the diameter a of the engagement contour 52. The spacing d is advantageously at most approximately 2.5 mm, in particular at most 1.5 mm. In the embodiment the spacing d is approximately 1 mm. The width f is advantageously smaller than the diameter a of the engagement contour 52. The outer diameter c of the circumferential wall 54, illustrated in FIG. 7, is advantageously also comparatively small so that only a small housing opening 18 is required. The outer diameter c of the circumferential wall 54 at the securing contour 19 is advantageously at most 2.5 times as large as the diameter a of the engagement contour 52. FIG. 8 shows schematically also the arrangement of the housing opening 18. The slot 78 which is formed between the rim of the housing opening 18 and the circumferential wall 54 on the side which is facing away from the air filter cover 16 has a width e that is advantageously smaller than the diameter a of the engagement contour 52. The width e is measured in a plane that is perpendicular to the axis of rotation 76. Advantageously, the width e is approximately half the diameter a of the engagement contour 52. The width e is advantageously less than approximately 4 mm, in particular less than approximately 3 mm. In order to avoid damage to the securing contour 19 and to protect the securing contour 19 from soiling, the securing contour 19 can be arranged in a plane below the housing opening 18. The spacing e is then measured in a projection of the housing opening 18 parallel to the axis of rotation 76 in the plane of the end face 55 of the circumferential wall 54.

For adjusting the supplied fuel quantity, the internal combustion engine 20 is advantageously put in operation and the tool 8 is positioned at the engagement contour 52 and the securing contour 19. With the securing sections 86 the carburetor rotor 37 is rotated into its idle position 88. In this position, the engagement contour 52 is adjusted by rotation of the grip 87 relative to the securing sections 86 until the desired idle position is reached. It can also be provided that the adjustment is carried out in one other or several other positions of the carburetor rotor 36. In order to secure the carburetor rotor 37 in other rotational positions, other configurations of the securing contour 19 and of the counter contour 83 can be expedient. As a result of the orientation of the first flanks 69 parallel to the axis of rotation 76, the configuration which is illustrated in the embodiment is particularly suitable for adjusting in idle position 88.

The specification incorporates by reference the entire disclosure of German priority document 10 2012 025 321.4 having a filing date of Dec. 22, 2012.

While specific embodiments of the invention have been shown and described in detail to illustrate the inventive principles, it will be understood that the invention may be embodied otherwise without departing from such principles.

What is claimed is:

1. A carburetor for a hand-guided power tool, the carburetor comprising:

a carburetor housing;

a carburetor rotor supported rotatably in the carburetor housing about an axis of rotation;

a needle disposed on the carburetor rotor and projecting into a fuel opening of the carburetor;

an adjusting element operatively connected to the needle so as adjust a position of the needle relative to the carburetor rotor, wherein the adjusting element is rotatable relative to the carburetor rotor for adjusting the position of the needle;

the adjusting element having an engagement contour adapted to be engaged by a tool for adjusting the adjusting element;

a securing contour, configured to secure the carburetor rotor against rotation about the axis of rotation, the securing contour fixedly connected to the carburetor rotor;

the securing contour, in a plan view of the securing contour in the direction of the axis of rotation, at any point of the securing contour, having a spacing relative to the axis of rotation of less than approximately 10 mm;

wherein the securing contour enables a fixation of the carburetor rotor against rotation about the axis of rotation so that the adjusting element can be rotated relative to the securing contour and an adjustment of the position of the needle by rotating the adjusting element relative to the carburetor rotor is possible without the carburetor rotor being rotated.

2. The carburetor according to claim 1, wherein the engagement contour is arranged in a recess which is delimited by a circumferential wall.

3. The carburetor according to claim 2, wherein the securing contour is arranged on the circumferential wall.

4. The carburetor according to claim 3, wherein the securing contour is arranged on an end face of the circumferential wall.

5. The carburetor according to claim 2, wherein an outer diameter of the circumferential wall at the securing contour is less than approximately 15 mm.

6. The carburetor according to claim 2, wherein an exterior side of the circumferential wall facing away from the recess has a locking element that is a component of a starter device.

7. The carburetor according to claim 2, wherein the circumferential wall has a circular ring-shaped cross-section.

8. The carburetor according to claim 2, wherein the spacing between the circumferential wall and the engagement contour is at most approximately 2.5 mm.

9. The carburetor according to claim 1, wherein the securing contour has at least one tooth.

10. The carburetor according to claim 1, wherein the securing contour has at least one first flank which is positioned at an angle of less than approximately 10° relative to the axis of rotation of the carburetor rotor.

11. The carburetor according to claim 10, wherein the first flank is oriented opposite to a rotational direction of the carburetor rotor for a rotation from an idle position to a full throttle position.

12. The carburetor according to claim 10, wherein the securing contour has at least one second flank that is positioned at an angle of approximately 20° to approximately 70° relative to the axis of rotation of the carburetor rotor.

13. The carburetor according to claim 1, wherein the engagement contour has a three-dimensional configuration and the tool has a three-dimensional configuration matched to the three-dimensional configuration of the engagement contour.

14. A hand-guided power tool comprising:

a power tool housing;

a carburetor arranged in the power tool housing and supplying fuel and combustion air to an internal combustion engine of the power tool;

the carburetor having a carburetor housing and a carburetor rotor rotatably supported about an axis of rotation in the carburetor housing;

the carburetor further having a needle disposed on the carburetor rotor and projecting into a fuel opening of the carburetor;

the carburetor further having an adjusting element operatively connected to the needle so as adjust a position of the needle relative to the carburetor rotor, wherein the adjusting element is rotatable relative to the carburetor rotor for adjusting the position of the needle, wherein the adjusting element has an engagement contour adapted to be engaged by a tool for adjusting the adjusting element;

the carburetor further having a securing contour, configured to secure the carburetor rotor against rotation about the axis of rotation, the securing contour fixedly connected to the carburetor rotor, wherein the securing contour, in a plan view of the securing contour in the direction of the axis of rotation, at any point of the securing contour, has a spacing relative to the axis of rotation of less than approximately 10 mm;

wherein the securing contour enables a fixation of the carburetor rotor against rotation about the axis of rotation so that the adjusting element can be rotated relative to the securing contour and an adjustment of the position of the needle by rotating the adjusting element relative to the carburetor rotor is possible without the carburetor rotor being rotated.

15. The power tool according to claim 14, wherein the power tool housing has a housing opening through which the securing contour is accessible, wherein between the securing contour and the housing opening a slot is formed.

16. The power tool according to claim 14, wherein a width of the slot is measured in a plane extending perpendicularly to the axis of rotation of the carburetor rotor, wherein a greatest width of the slot is less than approximately 7 mm.

17. The power tool according to claim 14, wherein a width of the slot is measured in a plane extending perpendicularly to the axis of rotation of the carburetor rotor, wherein a greatest width of the slot is smaller than a diameter of the engagement contour.

18. The power tool according to claim 14, wherein the slot is designed such that a round rod with a diameter of 7 mm cannot be inserted into the slot.

* * * * *